United States Patent [19]

Fabbri et al.

[11] Patent Number: 4,561,850

[45] Date of Patent: Dec. 31, 1985

[54] COLOR COORDINATOR DEVICE

[76] Inventors: Vittorio E. Fabbri, 8411 Crystal Springs Rd., Woodstock, Ill. 60098; Jackie D. Bell, 1595 Bedlington Dr., Barrington, Ill. 60010

[21] Appl. No.: 551,282

[22] Filed: Nov. 14, 1983

[51] Int. Cl.[4] ..... A45D 44/00

[52] U.S. Cl. ..... 434/98; 434/100; 434/84; 132/1 R

[58] Field of Search ..... 434/84, 94, 98, 99, 434/100, 101, 102, 104; 132/1 R, 88.5, 88.7, 79 R, 79 F

[56] References Cited

U.S. PATENT DOCUMENTS

| | | | |
|---|---|---|---|
| 1,582,122 | 4/1926 | Clapp | 434/99 |
| 2,238,316 | 4/1941 | Gaugler | 434/104 |
| 2,499,450 | 3/1950 | Bergman | 434/99 |
| 3,295,690 | 1/1967 | Ottman | 434/100 |
| 3,596,390 | 8/1971 | Scalice | 434/100 |
| 3,809,785 | 5/1974 | Calabrese et al. | 434/104 |
| 4,048,493 | 9/1977 | Lee | 434/98 |
| 4,199,877 | 4/1980 | Akiyama | 434/104 |

*Primary Examiner*—Robert Peshock
*Assistant Examiner*—Carolyn A. Harrison
*Attorney, Agent, or Firm*—Welsh & Katz, Ltd.

[57] ABSTRACT

A color coordinator device for use in the selection of personal cosmetic colors and the like having predetermined relation to the skin and eye colors of the user. The device includes a shield member defining a pocket and having a generally radial viewing opening formed therein, and a color coordinator disc rotatable within the pocket and having quadrant shaped groupings of color samples thereon representing different shades or tones of primary skin colors which may be brought into view through the viewing opening. The color coordinator disc has arcuate bands of color sample segments representing colors compatible with the corresponding skin tone colors and exposed with the skin tone colors for suggested cosmetic purposes such as eye shadow, blush, hair tint, lips and nail polish. Arcuate segmental portions of the color coordinator disc are adapted for removal from the disc, and a light filter may be provided to overlie the exposed color samples. The opposite side of the color coordinator disc preferably has a plurality of color samples thereon having color coordination with the various groups of skin tone shades on the primary side of the color coordinator disc, and provide selected colors or products for non-cosmetic accessories or uses.

11 Claims, 6 Drawing Figures

SKIN TONES
NAILS
LIPS
BLUSH
ROUGE
HAIR
EYE SHADOW
EYE COLOR
10
12
14
16
17
18a
18b
26
26a
28
38
40
44a
44b
44c
44d
44e
44f
44g
50a
50b
50c
52
56
56a
56b
56c
56d
56e
56f
56g
60
60a
60b
60c
60d
60e
60f
64
64a
64b
70
70a
3

SKIN TONES
12
16
20a
20b
26
26b
28
38
70

14
16
26
26a
26b
28
70
70a

COLOR COORDINATOR DEVICE

BACKGROUND OF THE INVENTION

The present invention relates generally to devices for assisting in the selection of colors and the like, and more particularly to a novel color coordinator device which facilitates the selection of colors for personal cosmetic purposes and for environmental accessories in relation to relatively constant characteristics of the user such as skin and eye colors.

It is a common practice in matters of personal grooming, particularly as they relate to the personal grooming habits of women, to select colors for cosmetic purposes and accessory items which are believed to be most compatible with the particular user and the "look" sought to be obtained. With the state of modern fashions, the selection of colors for personal cosmetic purposes as well as accessory items, such as clothing or other environmental items, is often difficult due to the great variety of colors which may be selected, some of which are less compatible with the user than others. While professional personal grooming services are available to assist women in the selection of cosmetics and the like, such services are unavailable to many women due to lack of scheduling opportunity and/or financial constraints.

In view of the foregoing, a need exists for a relatively simple and inexpensive device which will facilitate the selection of colors best suited for individual personal and environmental purposes. The present invention is directed to this need and provides a color coordinator device which enables an individual to select complimentary colors for personal cosmetic and environmental accessories. The color coordinator device in accordance with the present invention is based on the classical law of colors which holds that large areas dictate the consonant harmony of colors and small areas dictate the complimentary or contrasting color harmony. The invention is based on color selection in relation to the color of the user's skin, representing the largest area, and the color of the user's eyes, representing the smallest area, as the two relatively constant factors which dictate harmonious color selection. These two factors, i.e., skin and eye color, are particularly desirable as the basis for color selection for personal and environmental purposes for the reason that they follow the classic law of color selection which traditionally dictates the colors of cosmetics and accessory items. Moreover, they are the least likely colors to be permanently changed by chemical or cosmetic means.

SUMMARY OF THE INVENTION

One of the primary objects of the present invention is to provide a novel color coordinator device for use in selecting personal and environmental colors, and which is relatively inexpensive and uncomplicated in its use.

A more particular object of the present invention is to provide a novel color coordinator device which facilitates the selection of colors for personal grooming, such as eye shadow, blush or rouge, hair, nails and lips based upon the major color tone of the user's skin and the color of the user's eyes.

A further object of the present invention is to provide a novel color coordinator device which facilitates the selection of both personal grooming colors for cosmetic purposes as well as the selection of colors for accessory items, all of which are based upon the primary skin tone color of the user and the color of the user's eyes.

In accordance with one feature of the invention, a color coordinator disc is provided having an outer peripheral band of color segments arranged in predetermined groupings, such as quadrant arrays, with each grouping being representative of a predominant skin color classification such that the user's skin color is a constant factor in determining the consonant harmony of colors selected for the larger facial areas, such as hair and cheek areas, and having various concentric bands of different but compatible color samples thereon which facilitate selection of color shades for cosmetic eye shadow, rouge, lips and nails, the disc being substantially covered by a shield member having a viewing opening operative to expose a selected group of skin color shade samples and thereby simultaneously exposing the color compatible accessory colors from which the user may select accessory colors.

Further objects, advantages and features of the invention will become apparent from the following detailed description when taken in conjunction with the accompanying drawings wherein like reference numerals designate like elements throughout the several views.

DESCRIPTION OF PREFERRED EMBODIMENT

Figure 1:
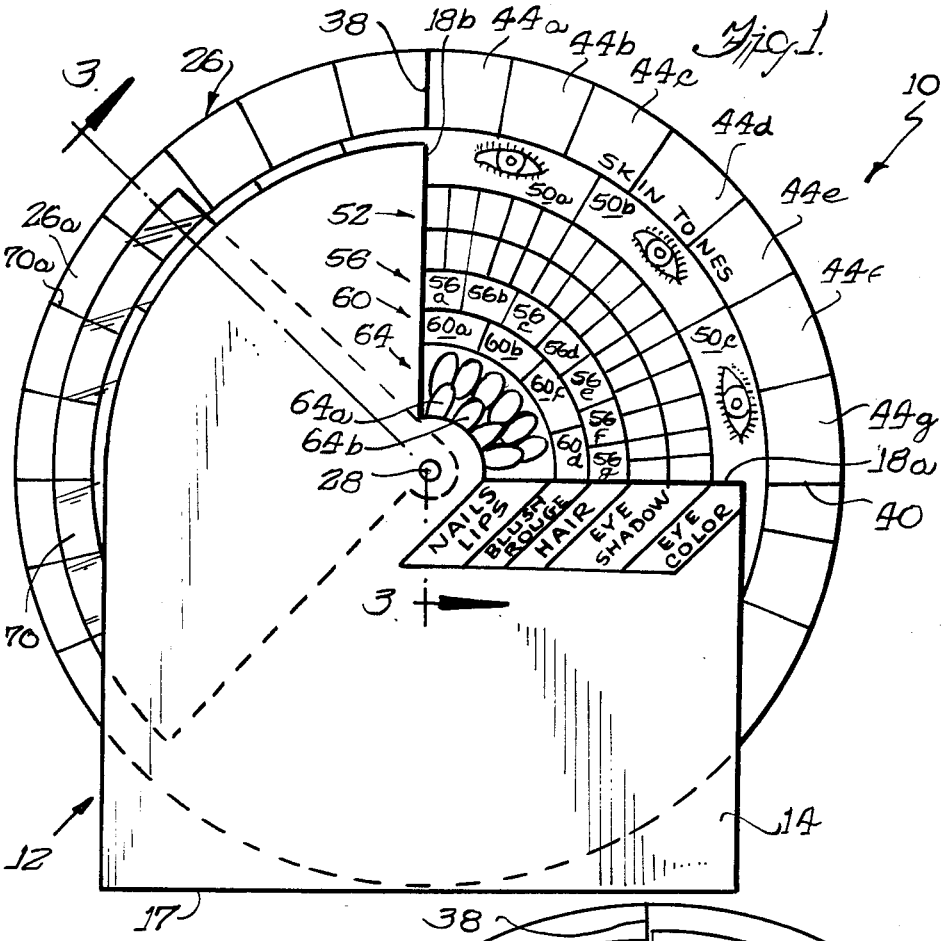
FIG. 1 is a plan view of a color coordinator device constructed in accordance with the present invention.

Referring now to the drawings, a color coordinator device constructed in accordance with the present invention is indicated generally at 10. The color coordinator device 10 finds particular application in facilitating the selection of colors for personal cosmetic purposes, and, preferably, also facilitates color selection for environmental accessories in relation to relatively constant characteristics of the user such as skin and eye colors.

The color coordinator device 10 includes a shield or mask member, indicated generally at 12, which also serves as a holder and includes front and rear panels or plates 14 and 16 which are preferably made of a relatively lightweight sheet material, such as a relatively thin plastic or paperboard material. In the illustrated embodiment, the panels or plates 14 and 16 are connected along an integral fold edge 17 and have generally semi-circular edge configurations opposite the fold edge 17 except for quadrant or 90° pie-shaped openings formed therein, as defined between radial edge lines 18*a,b* and 20*a,b*, respectively. The quadrant shaped openings thus defined are formed so as to lie in superimposed relation to each other. If desired, the front and rear panels 14 and 16 may be formed as circular panels having approximately one-half or 180° of their peripheral edges radially extended to establish mutually abutting edges which may be suitably affixed to each other.

The panels 14 and 16 define a pocket or cavity therebetween in which is rotatably supported a circular color coordinator disc, indicated generally at 26. The disc 26 has a larger diameter than the diameter of arcuate portions of panels 14 and 16 and is rotatably supported by and between the panels through a pivot pin 28 which extends through a suitable aperture centrally of disc 26. In this manner, the circular color coordinator disc 26 may be readily rotated about its center axis on the pivot pin 28 relative to the shield or mask member 12 so as to expose selected surface areas of the coordinator disc within the quadrant shaped viewing openings in panels 14 and 16. The color coordinator disc 26 is also preferably made of a relatively thin lightweight material suitable to enable forming or support of color samples thereon, to be described, and of sufficient strength to maintain a generally flat condition and facilitate rotation relative to the shield member 12.

Figure 4:
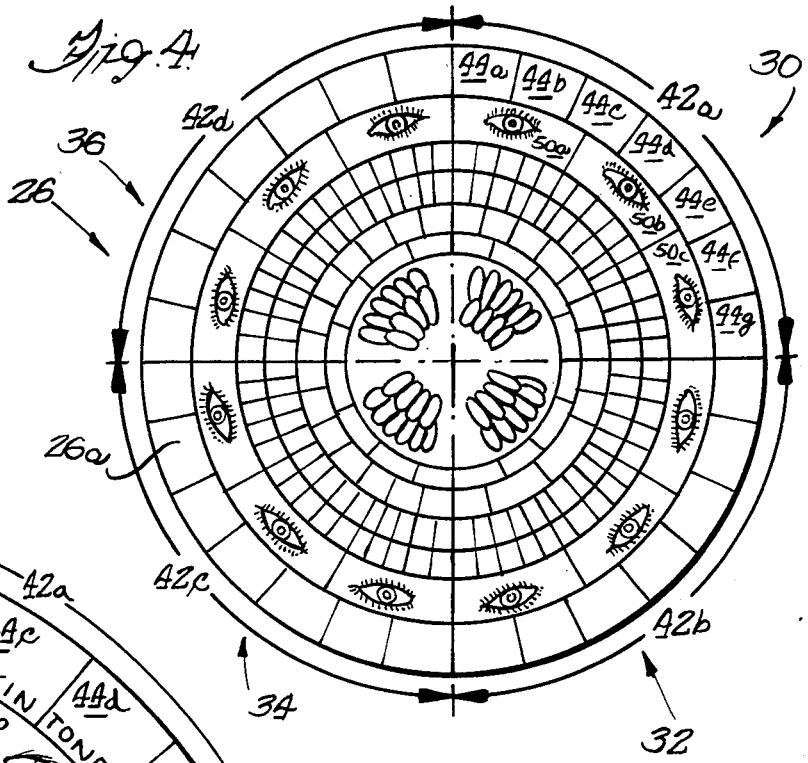
FIG. 4 is a plan view showing the color coordinator disc employed in the device of FIG. 1.
Figure 5:
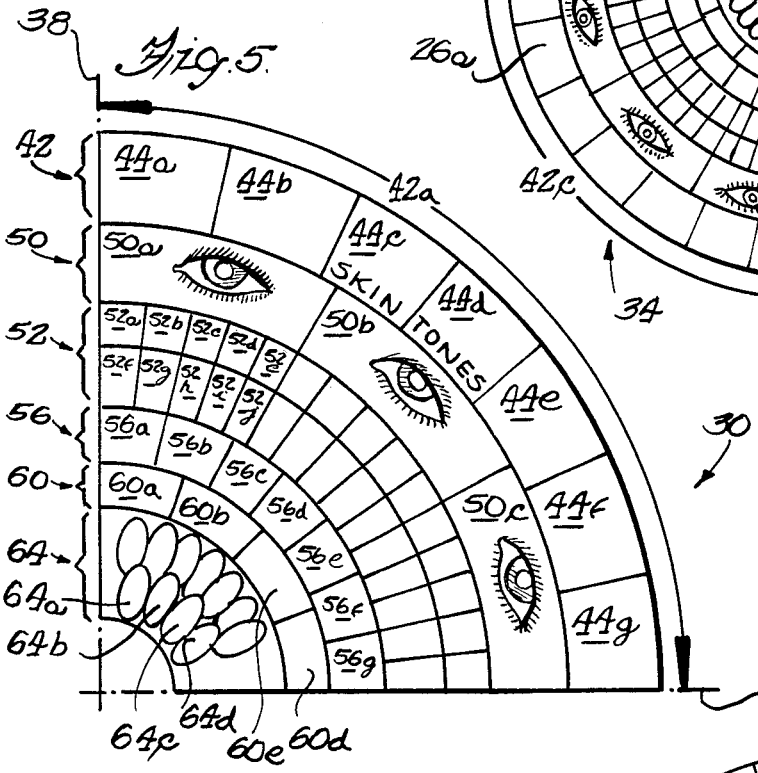
FIG. 5 is an enlarged plan view of one quadrant of the color coordinator disc shown in FIG. 4.

Referring particularly to FIGS. 4 and 5, taken in conjunction with FIG. 1, the color coordinator disc 26 has a generally planar surface 26*a* which, when the coordinator disc is mounted between the panels 14 and 16, is partially exposed through the viewing opening defined between the radial edges 18*a,b*. In the illustrated embodiment, the surface 26*a* is divided into four quadrants or 90° pie-shaped segments, indicated generally at 30, 32, 34 and 36, established between diametral lines 38 and 40 which intersect at right angles to each other at the center of the circular disc. The quadrants 30, 32, 34 and 36 are generally similar in that each quadrant contains a plurality of predetermined coordinated color samples which are color coordinated in their respective quadrant areas and relate to predetermined characteristics of the human body such as skin and eye color.

To this end, the surface 26*a* of the color coordinator disc 26 has a first outer annular band, indicated generally at 42 in FIG. 5, adjacent its outer peripheral edge which, for purposes of illustration, is shown in FIG. 4 as comprising four arcuate shaped quadrant portions 42*a–d* each of which corresponds to and lies in an associated one of the quadrant areas 30, 32, 34 and 36, respectively. Each of the arcuate portions 42*a–d* of the outer band 42 represents one of four major or primary color categories into which the human skin may be classified such as red, yellow, blue and black. Taking quadrant 30 as being representative of the four quadrants 30, 32, 34 and 36, and referring to FIG. 5, the corresponding arcuate portion 42*a* of band 42 is divided into a plurality of substantially equal size generally trapezoidal shaped segments which, in the illustrated embodiment, comprise seven segments 44*a–g* each of which has a different color sample thereon representative of one tone or shade of the corresponding primary skin color category associated with quadrant 30, such as yellow.

The surface 26*a* of the color coordinator disc 26 has a second annular band, indicated generally at 50, disposed radially inwardly from and substantially concentric with the outer band 42, the band 50 being similarly divided into four 90° arcuate shaped portions corresponding to and lying within corresponding ones of the quadrant shaped segments 30, 32, 34 and 36. Each 90° arcuate portion of the annular band 50 is in turn divided into three substantially equal size segments, such as indicated at 50*a*, 50*b* and 50*c* within the quadrant 30, each of the segments 50*a–c* being of generally trapezoidal shape and having an arcuate extent of approximately 30°. Each segment 50*a–c* corresponds to and identifies a predetermined eye color which is generally associated with the corresponding skin shades or tones within color segments 44*a–g* in the corresponding quadrant 30. The eye colors are preferably denoted by indicia or eye shaped representations colored to visually identify the particular eye color, such as blue, hazel, brown, etc.

Each of the 30° arcuate segments 50*a–c* further has a plurality of substantially equal size trapezoidal shaped sub-segments associated therewith, which lie in a double row annular band indicated generally at 52 in FIG. 5. Each 30° arcuate segment of annular band 52 is divided into a plurality of substantially equal size segments, such as indicated at 52*a–j* in the 30° arcuate area corresponding to area 50*a*. Each segment 52*a–j* is of a different color representative of various eye shadow colors compatible with the eye color in the corresponding eye color segment, such as 50*a*, and which are compatible with the corresponding skin color tones in the associated quadrant 30.

The color coordinator disc 26 has a further annular band, indicated generally at 56, formed thereon disposed radially inwardly from and substantially concentric with the double row annular eye shadow color band 52, the band 56 being similarly defined by 90° arcuate portions lying within the four quadrants 30, 32, 34 and 36. Each 90° arcuate portion of the annular band 56 is divided into a plurality of substantially equal size generally trapezoidal shaped segments, such as indicated at 56*a–g* in FIG. 5, each of which displays or has color indicia thereon representing a different color of hair tinting which is compatible in color harmony with the associated skin color tones displayed on the corresponding quadrant portion of the outer band 42.

Another annular band, indicated generally at 60, is formed on the color coordinator disc 26 radially inwardly from and substantially concentric with annular band 56. Annular band 60 is also made up of four 90° arcuate portions each of which lies in a corresponding one of the quadrants 30, 32, 34 and 36 of the color coordinator disc. Each of the 90° arcuate portions of band 60 is in turn divided into a plurality of substantially identical size generally trapezoidal shaped segments, there being four such segments in each 90° arcuate portion of the band 60, as indicated at 60*a–d* in FIG. 5. Each of the segments 60*a–d* bears indicia or data thereon relating to a blush and/or rouge color compatible in color harmony with the skin color shades or tones on the portion of the band 42 within the corresponding quadrant of the color coordinator disc 26, the various blush/rouge color samples being suggestive for possible tinting of hair in conjunction with cosmetic make-up and the like.

The color coordinator disc 26 has an inner annular band formed thereon, indicated generally at 64, which is disposed radially inwardly from and substantially concentric with the annular band 60 and which also includes a 90° arcuate portion in each of the four quadrants of the color coordinator disc. In the illustrated embodiment, each quadrant portion of band 64 depicts a plurality of fingernail-shaped or generally oval-shaped areas, four of which are indicated at 64*a–d*, on which different colors are displayed as suggestions for fingernail and/or lip color cosmetics compatible with the corresponding skin color tones or shades shown on the portion of the outer band 42 within the corresponding quadrant of the color coordinator disc. Alternatively, each quadrant portion of the annular band 64 may be divided into a plurality of substantially identical size generally trapezoidal shaped segments, each having different color indicia or data thereon representative of a suggested nail polish and/or lip color.

With the color coordinator disc 26 as thus described positioned between and rotatable relative to the panels 14 and 16 of the mask member 12, the color coordinator disc may be rotated to a position exposing the basic skin color tones or shades corresponding to the primary skin color category of the user. The color coordinator disc may be positioned to expose the proper grouping of skin color shades by comparing, preferably in direct daylight, the various color samples on the outer band 42 with the back of the user's hand or with the user's face skin without make-up thereon. By identifying the skin color sample in the band 42 closest to the user's skin and exposing it and the corresponding quadrant area of the coordinator disc within the quadrant shaped viewing opening in panel 14, the color coordinator disc is in proper position to present a particular range of colors for various cosmetic purposes which are highly complimentary to the user's skin tone. Thus, after properly positioning the color coordinator disc, the user may select an eye shadow color from the various color samples, such as 52*a–j*, corresponding to the eye color in the one of the three exposed segment areas 50*a,b* or *c* which is closest to the color of the user's eye. The user may also select a hair tinting color from any of the color samples in the exposed color areas 56*a–g* of band 56, a rouge and/or blush color from any of the exposed color sample segments 60*a–d*, and a nail polish and/or lip color from any of the exposed color samples in band 64.

Figure 2:
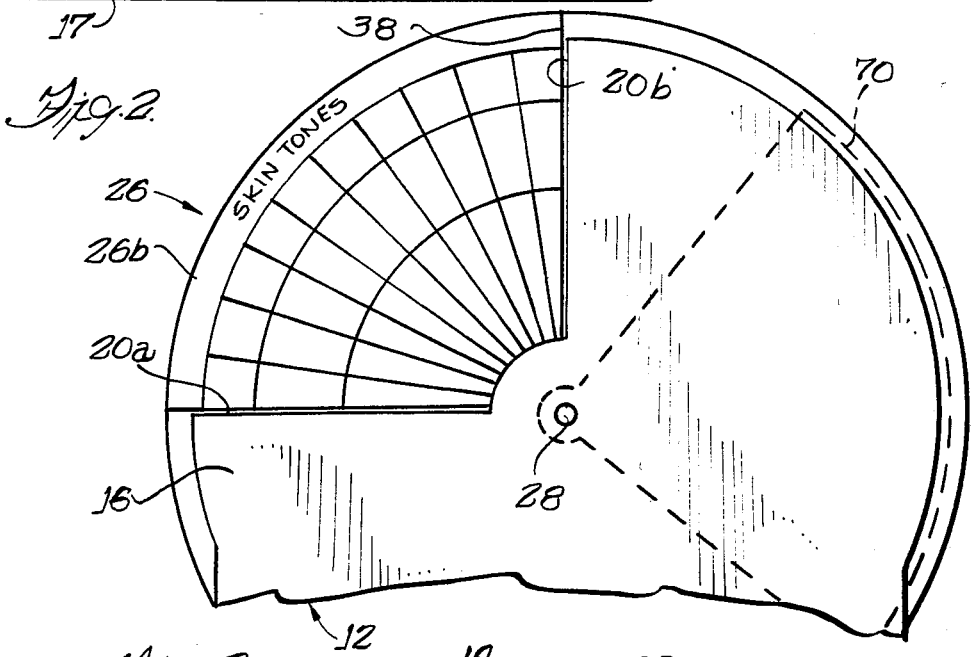
FIG. 2 is a plan view illustrating the opposite side of the color coordinator device shown in FIG. 1.
Figure 3:
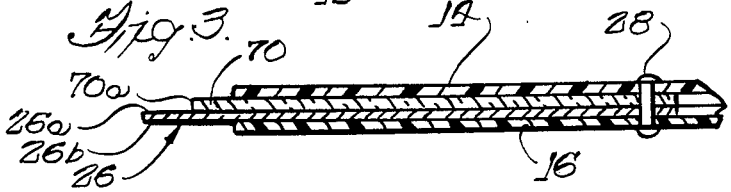
FIG. 3 is a fragmentary sectional view taken substantially along line 3—3 of FIG. 1, looking in the direction of the arrows.
Figure 6:
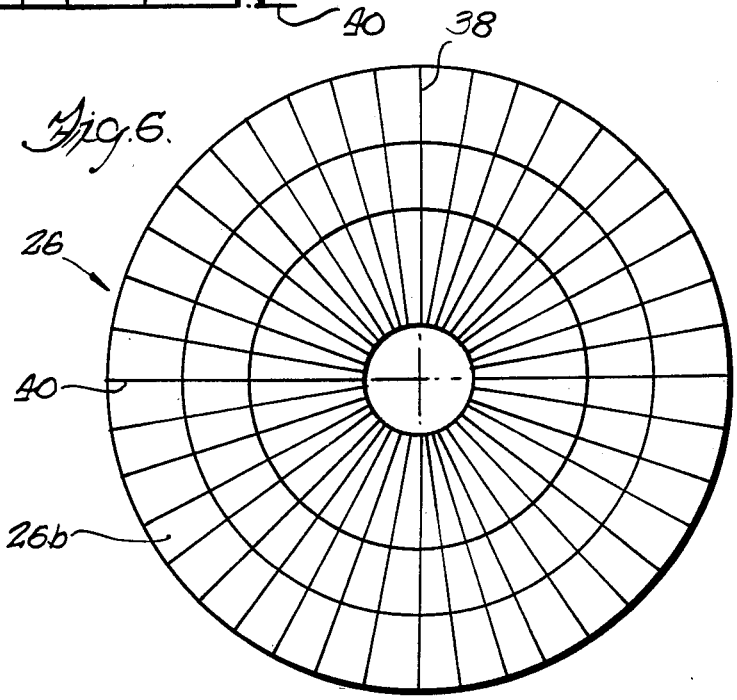
FIG. 6 is a plan view of the opposite side of the disc of FIG. 4.

The color coordinator device 10 preferably has a plurality of selectively positioned color samples on the rear surface 26*b* of the color coordinator disc 26 opposite the surface 26*a* on which the aforedescribed personal cosmetic color samples are presented. With particular reference to FIG. 6, taken in conjunction with FIG. 2, the side 26*b* of disc 26 is also preferably divided into four substantially equal quadrants or 90° pie-shaped segments by the diametral lines 38 and 40 in similar fashion to and in corresponding position of the four quadrants defined on surface 26*a*.

The surface 26*b* of the color coordinator disc 26 has a plurality of annular concentric bands formed thereon so as to establish a plurality of radially adjacent 90° arcuate strips or areas in each quadrant. Each such 90° arcuate strip or area is subdivided into a plurality of substantially equal size generally trapezoidal shaped segment areas such that each quadrant of the circular surface 26*b* has substantially the same number of trapezoidal segment areas formed thereon. The various trapezoidal shaped areas within each quadrant of the disc surface 26*b* have color indicia or data thereon having predetermined color compatible relation to the skin tone color samples displayed on band 42 within the corresponding quadrant areas 42*a–d* on the opposite side of the color coordinator disc. The different color samples present in each quadrant on surface 26*b* of the color coordinator disc 26 represent color shades suggested for color coordinator wardrobe or environmental objects or the like which are compatible with the general skin color tone or shade of the user.

With the side 26*b* of the color coordinator disc 26 having a plurality of colors thereon which are in color harmony with the skin color tones displayed within the corresponding quadrant areas on the opposite surface 26*a* of the color coordinator disc, after selecting color shades for various personal cosmetic purposes from side 26*a*, the user may turn the color coordinator device over and select colors for wardrobe and accent, etc., from the color samples presented within the corresponding quadrant shaped viewing opening formed in panel 16.

As an alternative to presenting only color samples on the side 26*b* of the color coordinator disc 26, other indicia or graphics could be displayed to assist in selection of items other than merely colors. For example, at least a portion of each quadrant area on surface 26*b* of the color coordinator disc 26 might be divided into discrete areas each of which displays indicia thereon indicating a particular type of human personality, such as "reserve", "outgoing" and/or "outdoor type" personality, and a particular type of item or product, such as a particular model of automobile, which is suggested as being particularly compatible with the corresponding personality category. Other suggested products, such as jewelry, etc., and/or color suggestions could also be provided on the surface 26*b* so as to suggest products or color samples which are coordinated with or have predetermined contrast with the particular personalities or with the various major skin color groupings on side 26*a* of the color coordinator disc 26.

Referring again to FIGS. 4 and 5, another feature of the color coordinator device 10 is the provision of score lines along the diametral lines 38 and 40 on the color coordinator disc 26 so that the score lines extend radially from the center of the disc outwardly to the outermost edge of the circular disc. Such score lines may be formed as continuous or intermittent score lines and define lines of weakness or tear lines which enable the user to readily remove a selected one of the quadrants of the color coordinator disc which corresponds to the primary color category of the user's skin. By removing the selected quadrant shaped portion from the color coordinator disc 26, the user may more easily carry the pertinent portion of the color coordinator disc on his or her person for easy access and reference as needed.

Another feature of the color coordinator device 10 lies in the provision of a filter element, indicated at 70 in FIG. 1, for use in accommodating the device to varying light conditions. In the illustrated embodiment, the filter element 70 has a quadrant or generally 90° arcuate segment configuration and is rotatably mounted on the pivot pin 28 between panel 14 and the color disc surface 26*a*. The filter element has an outer peripheral margin 70*a* which extends radially outwardly from the semicircular shaped portion of panel 14 and is movable from a position substantially underlying the panel 14 of the shield member 12 to a position overlying the exposed surface portion of the color coordinator disc 26. It will be understood that the panels 14 and 16 are not secured together except along fold edge 17 so that the filter element 70 is free to be rotated therebetween. The filter 70 is made of a suitable material having light filtering characteristics which, when the filter directly overlies the disc surface 26*a*, are capable of filtering the underlying color samples so as to provide a true color representation even though the color coordinator device may be employed in intense direct sunlight. The filter element 70 could, for example, comprise a plastic type filter of conventional filter material, such as employed in photographic light filters, having one or more color filter areas.

While a preferred embodiment of the present invention has been illustrated and described, it will be understood that changes and modifications may be made therein without departing from the invention in its broader aspects. For example, the color coordinator disc 26 could be rectangular or polygonal in plan configuration, with the mask or shield member 12 being suitably configured for cooperation with the color coordinate disc so as to facilitate operation in similar fashion to the aforedescribed embodiment of the color coordinator device 10.

Various features of the invention are defined in the following claims.

What is claimed is:

1. A color coordinator device for use in the selection of personal cosmetic colors and the like having predetermined relation to the skin and eye colors of the user, said device comprising;

a shield member including a pair of panels defining a pocket therebetween, at least one of said panel having a viewing opening formed therein, a generally planar color coordinator disc disposed within said pocket and supported for rotation relative to said shield member, said color coordinator disc having on one side thereof a first outer annular peripheral band adjacent its outer peripheral edge defining a plurality of different color segments arranged in predetermined generally arcuate groupings such that the color segments within each grouping represent a different shade or tone of a primary skin color, said color coordinator disc having a second annular band formed on said one side thereof and defining a plurality of segment areas each identifying a predetermined eye color having predetermined relation with a corresponding arcuate grouping of color segments in said first annular band, each of said eye color segment areas including a plurality of different color samples representative of eye shadow colors compatible with the corresponding eye color, said color coordinator disc having a third annular band formed on said one side thereof and defining a plurality of segment areas having predetermined relation to a corresponding arcuate grouping of color segments in said first annular band and each bearing indicia relating to a hair tint color suggested for the corresponding arcuate grouping of skin color shades, said color coordinator disc having a fourth annular band formed on said one side thereof and defining a plurality of segment areas each having a different color sample thereon having predetermined color relation to a corresponding arcuate grouping of skin color shades and representing a color of facial make-up suitable for use by a person whose skin color falls within the range of the corresponding arcuate grouping of skin color shades, said color coordinator disc having a fifth annular band formed on said one side thereof and defining a plurality of segment areas having predetermined relation to the corresponding arcuate grouping of skin color segments in said first annular band, said segment areas of said fifth annular band bearing color indicia thereon representative of nail polish or lip colors compatible with said corresponding skin color segments, said viewing opening being sized to enable positioning of said color coordinator disc so that a selected one of said predetermined arcuate groupings in said first annular band and the color segment areas in the corresponding arcuate portions of said second, third, fourth and fifth bands are exposed to facilitate color selections from the various exposed color segment areas, said color coordinator disc being arranged in arcuate segment areas defined between radial lines which define lines of weakness adapted to enable removal of a selected one or more of said arcuate segment areas.

2. A color coordinator device as defined in claim 1 wherein said viewing opening is generally V-shaped and extends from substantially the geometric center of said shield member outwardly and intersects the outer peripheral edge of the corresponding panel.

3. A color coordinator device as defined in claim 2 wherein said viewing opening comprises a quadrant shaped opening in said one of said panels.

4. A color coordinator device as defined in claim 1 wherein said first, second, third, fourth and fifth annular bands are defined by contiguous concentric bands.

5. A color coordinator device as defined in claim 1 wherein each of the said predetermined generally arcuate groupings of color segments in said first annular band comprises a substantially 90° arcuate portion of the periphery of said color coordinator disc, said second, third, and fourth annular bands each being arranged with its corresponding color segments having predetermined relation with a selected one of said 90° arcuate portions of said first annular band.

6. A color coordinator device as defined in claim 5 wherein said color segments in said first, second, third, and fourth bands are substantially trapezoidal in plan configuration, the color segments in each annular band being of substantially equal size to each other.

7. A color coordinator device as defined in claim 1 including a light filter member disposed between said one side of said color coordinator disc and said one of said panels, said filter member being movable between a position angularly spaced from said viewing opening and a position within said viewing opening overlying the exposed portion of said color coordinator disc.

8. A color coordinator device as defined in claim 7 wherein said light filter member has a generally arcuate configuration and is mounted for rotation about the axis of rotation of said color coordinator disc.

9. A color coordinator device as defined in claim 8 wherein said indicia on said opposite side of said color coordinator disc identifies accent colors arranged in predetermined groupings so as to have color compatibility with the color segments in said first annular band on said one side of said color coordinator disc.

10. A color coordinator device for use in the selection of personal cosmetic colors having predetermined relation to the skin and eye colors of the user, said device comprising a shield member including a pair of panels defining a pocket therebetween, at least one of said panels having a generally radially extending viewing opening formed therein, and a generally planar color coordinator disc disposed within said pocket and supported for rotation relative to said shield member, said color coordinator disc having on one side thereof a plurality of arcuate bands disposed in generally parallel relation relative to the axis of rotation of said color coordinator disc, the outermost one of said arcuate bands defining a plurality of color sample segment areas each of which represents a different shade or tone of a primary skin color, the remaining arcuate bands each defining a plurality of segment areas having indicia thereon representing color samples having predetermined compatible relation with the skin shade colors in the portion of the outermost arcuate band disposed within the same arcuate segmental portion of said color coordinator disc, said color samples in said remaining arcuate bands representing suggested colors for cosmetic facial make-up, hair tinting, nails and lips, said color coordinator disc being arranged in arcuate segment areas defined between radial lines which define lines of weakness adapted to enable removal of a selected one or more of said arcuate segments of said color coordinator disc.

11. A color coordinator device for use in the selection of personal cosmetic colors and the like having predetermined relation to the skin and eye colors of the user, said device comprising;

a shield member including a pair of panels defining a pocket therebetween, at least one of said panels having a viewing opening formed therein, and a generally planar color coordinator disc disposed within said pocket and supported for rotation relative to said shield member, said color coordinator disc having on one side thereof a first outer annular peripheral band adjacent its outer peripheral edge defining a plurality of different color segments arranged in predetermined generally arcuate groupings such that the color segments within each grouping represent a different shade or tone of a primary skin color, said color coordinator disc having a second annular band formed on said one side thereof and defining a plurality of segment areas each identifying a predetermined eye color having predetermined relation with a corresponding arcuate grouping of color segments in said first annular band, each of said eye color segments areas including a plurality of different color samples representative of eye shadow colors compatible with the corresponding eye color, said color coordinator disc having a third annular band formed on said one side thereof and defining a plurality of segment areas having predetermined relation to a corresponding arcuate grouping of color segments in said first annular band and each bearing indicia relating to a hair tint color suggested for the corresponding arcuate grouping of skin color shades, said color coordinator disc having a fourth annular band formed on said one side thereof and defining a plurality of segment areas each having a different color sample thereon having predetermined color relation to a corresponding arcuate grouping of skin color shades and representing a color of facial make-up suitable for use by a person whose skin color falls within the range of the corresponding arcuate grouping of skin color shades, said color coordinator disc having a fifth annular band formed on said one side thereof and defining a plurality of segment areas having predetermined relation to the corresponding arcuate grouping of skin color segments in said first annular band, said segment areas of said fifth annular band bearing color indicia thereon representative of nail polish or lip colors compatible with said corresponding skin color segments, said viewing opening being sized to enable positioning of said color coordinator disc so that a selected one of said predetermined arcuate groupings in said first annular band and the color segment areas in the corresponding arcuate portions of said second, third, fourth and fifth bands are exposed to facilitate color selections from the various exposed color segment areas, the other of said pair of panels having a generally V-shaped viewing opening formed therein corresponding to the angular position of said viewing opening in said one of said panels, the side of said coordinator disc opposite said one side thereof having a display of indicia thereon so that positioning of said color coordinator disc to expose predetermined color samples on said one side thereof effects exposure of predetermined indicia on said opposite side.

* * * * *